United States Patent [19]

Cunningham et al.

[11] 4,448,615

[45] May 15, 1984

[54] METHOD OF SPOT ANNEALING TUBING

[75] Inventors: James L. Cunningham; John M. Tatum, both of Decatur, Ala.

[73] Assignee: UOP Inc., Des Plaines, Ill.

[21] Appl. No.: 449,967

[22] Filed: Dec. 15, 1982

Related U.S. Application Data

[62] Division of Ser. No. 375,781, May 6, 1982, abandoned.

[51] Int. Cl.[3] ..... C21D 1/18

[52] U.S. Cl. ..... 148/13; 148/156; 148/155; 148/154; 432/8; 219/155

[58] Field of Search ..... 148/156, 155, 150, 153, 148/154, 13; 219/155, 156

[56] References Cited

U.S. PATENT DOCUMENTS

| | | | |
|---|---|---|---|
| 2,450,362 | 9/1948 | Scott | 219/156 |
| 3,708,354 | 1/1973 | Rowell | 148/128 |

FOREIGN PATENT DOCUMENTS

| | | | |
|---|---|---|---|
| 339590 | of 1972 | U.S.S.R. | 219/155 |
| 481142 | 11/1975 | U.S.S.R. | 219/156 |
| 197711 | 11/1977 | U.S.S.R. | 219/156 |

*Primary Examiner*—L. Dewayne Rutledge

*Assistant Examiner*—Christopher W. Brody

*Attorney, Agent, or Firm*—James R. Hoatson, Jr.; Barry L. Clark; William H. Page, II

[57] ABSTRACT

In the manufacture of tubing, and particularly finned tubing, for use by the heat transfer industry in the manufacture of heat exchangers, annealed ends and lands are desirable in certain applications to facilitate the assembly of the tubes to headers and baffles by expanding techniques. Such spot-annealed portions can be produced on a continuous basis by the described apparatus and method in which the moving tube is passed through a heating chamber which reciprocates on a carriage in the direction of tube movement. The heating chamber has a pair of power-actuated, current-carrying clamps which grip spaced portions of the tube so as to resistance-heat the tube portion between the clamps. The heating chamber and carriage move with the tube while it is clamped to provide sufficient heating time. The carriage then returns to its starting position. If desired, an inert gas can be supplied to the heating chamber to prevent oxidation and/or discoloration. Also, if desired, a quench can be supplied in a secondary chamber positioned on the carriage immediately downstream of the heating chamber to prevent post-oxidation of the annealed tube.

4 Claims, 2 Drawing Figures

METHOD OF SPOT ANNEALING TUBING

This is a division of application Ser. No. 375,781, filed May 6, 1982 now abandoned.

BACKGROUND OF THE INVENTION

The invention relates to the annealing of tubing and similar elongated products such as rods or wires. More particularly, it relates to the annealing of elongated products on which it is sometimes desirable to have at least selected portions of their length in an annealed state. One such product is straight lengths of finned tubing to be used in heat exchangers. Such tubing has been conventionally processed in short lengths cut from a straightened portion of a large coil which has been annealed. The short lengths have a long mandrel inserted in them and are then positioned in a fin rolling apparatus which is capable of selectively moving the finning members into and out of contact with the tubing so that unfinned lands and ends can be provided. When the unfinned portions are in an annealed state, the tubes can be more easily assembled into the tube sheet header and baffle portions of heat exchangers by internal expansion techniques.

Techniques previously used to anneal such tubes have included both batch and continuous techniques. In the batch technique, the entire coil or individual tube length must be placed in a furnace for an extended period. The process is very time-consuming, requires very expensive capital equipment, and also utilizes a large amount of energy. Continuous annealing techniques have also been developed, one example of which can be seen in Herren et al U.S. Pat. No. 3,518,405. In this apparatus, the tubing is bent partially around each of a spaced pair of current-carrying electrode wheels which cause the portion of the tubing between the wheels to be heated. The electrode wheels are typically made of graphite which wears relatively rapidly, thus causing a substantial expense in maintenance, electrode replacement and downtime. Another example can be seen in Judd, U.S. Pat. No. 4,309,887 wherein the entire tube is continuously annealed by an induction heater.

SUMMARY OF THE INVENTION

It is among the objects of the present invention to provide an annealing apparatus which can be operated as an integral part of a high speed continuous finning operation which produces a large number of short tube lengths from a large coil. It is an additional object to provide such an apparatus which is relatively compact and simple, able to operate for extended periods with little maintenance, and very energy efficient.

These and other objects and advantages are attained by the apparatus and method of the present invention in which selective or "spot" annealing of spaced portions along the length of a continuously moving tube can take place at a speed which is at least sufficient to accommodate a downstream finning operation. However, the apparatus could also be used independently of any downstream operations to spot anneal plain tube or wire or rod stock. The apparatus includes an annealing chamber mounted on a reciprocating carriage which can move in the direction of the tube or other workpiece. The annealing chamber contains a pair of spaced, automatically actuated tube engaging clamps which are energized after they engage the tubing to carry electrical current which rapidly heats the portion of the tubing located between the clamps. During the limited time that the clamps engage the moving tubing, they cause the chamber and carriage to be moved downstream with the tubing. Upon release of the clamps, an air cylinder or other means rapidly returns the carriage upstream to its starting position. A quenching chamber is preferably mounted on the carriage immediately downstream of the annealing chamber so that the just-annealed portion of the tubing can be rapidly cooled as the carriage returns upstream. The quenching can prevent post-annealing oxidation and/or discoloration while the injection of an inert gas atmosphere such as nitrogen into the annealing chamber prevents oxidation and/or discoloration during annealing. In many, if not most situations in which the resulting spot-annealed tubes are used, such surface defects would have no effect on the tube performance. However, since a bright, shiny tube certainly is more esthetically pleasing to a purchaser than a dull, discolored one, it is usually advantageous to use an inert atmosphere and a quench. In order to provide annealed tube sections with the grain and hardness properties desired, the annealing time and current value can be selectively controlled. The clamping time and the annealing time are preferably controlled by electrical relays in response to signals from a mini-computer. The computer receives its signals from a counter which is actuated by a wheel encoder which is rotated by the moving tube. The aforementioned elements which are conventional, ensure that only those portions of the tubing which are to be left unfinned in a downstream finning operation will be annealed. The elements also permit arcing to be avoided by actuating the clamps to contact the tube for a small time interval before and after the current is applied.

DETAILED DESCRIPTION OF THE PREFERRED EMBODIMENT

Figure 1:
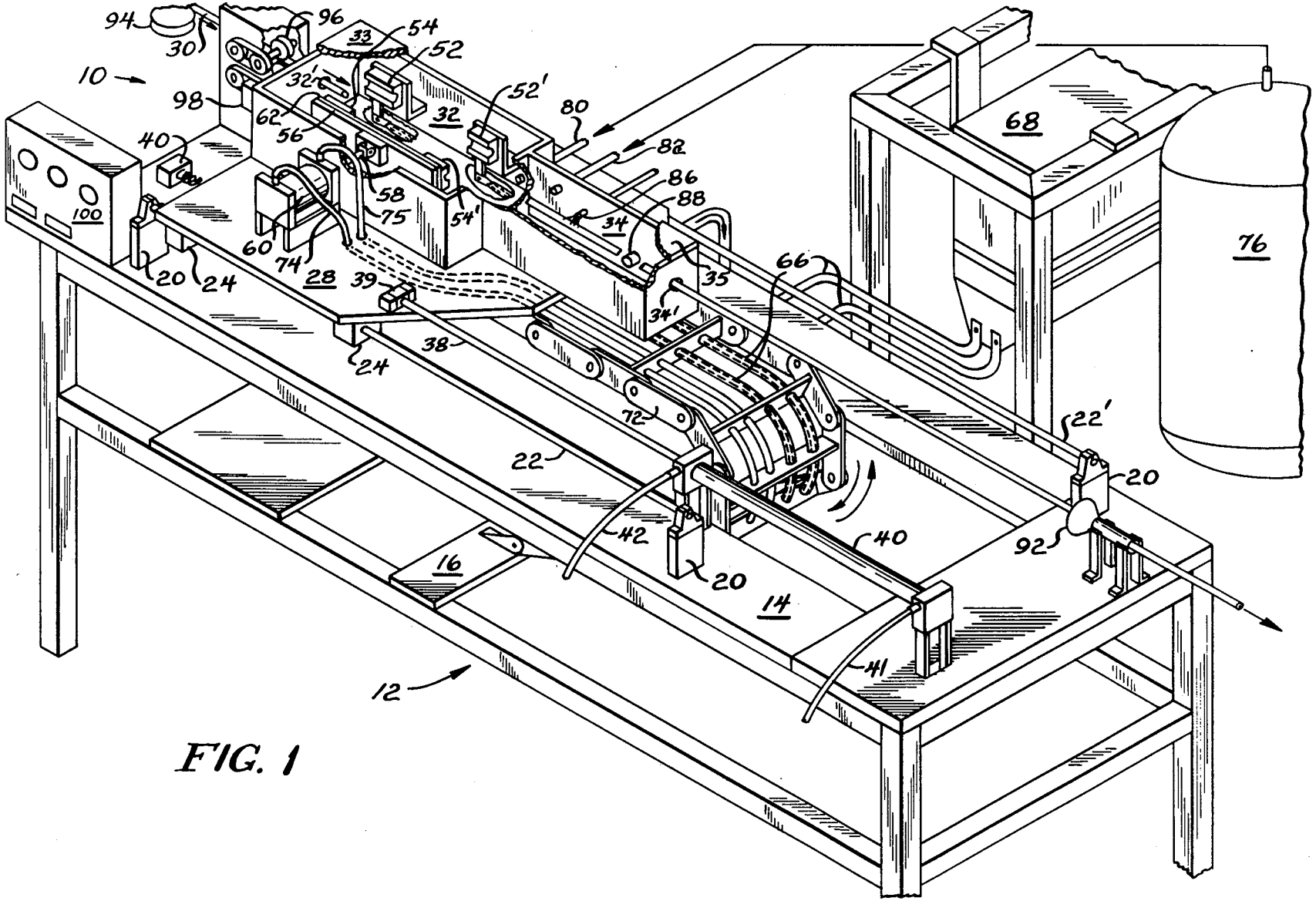
FIG. 1 is an isometric view of the improved annealing apparatus and its relationship to a length of tubing being positively driven through it.
Figure 2:
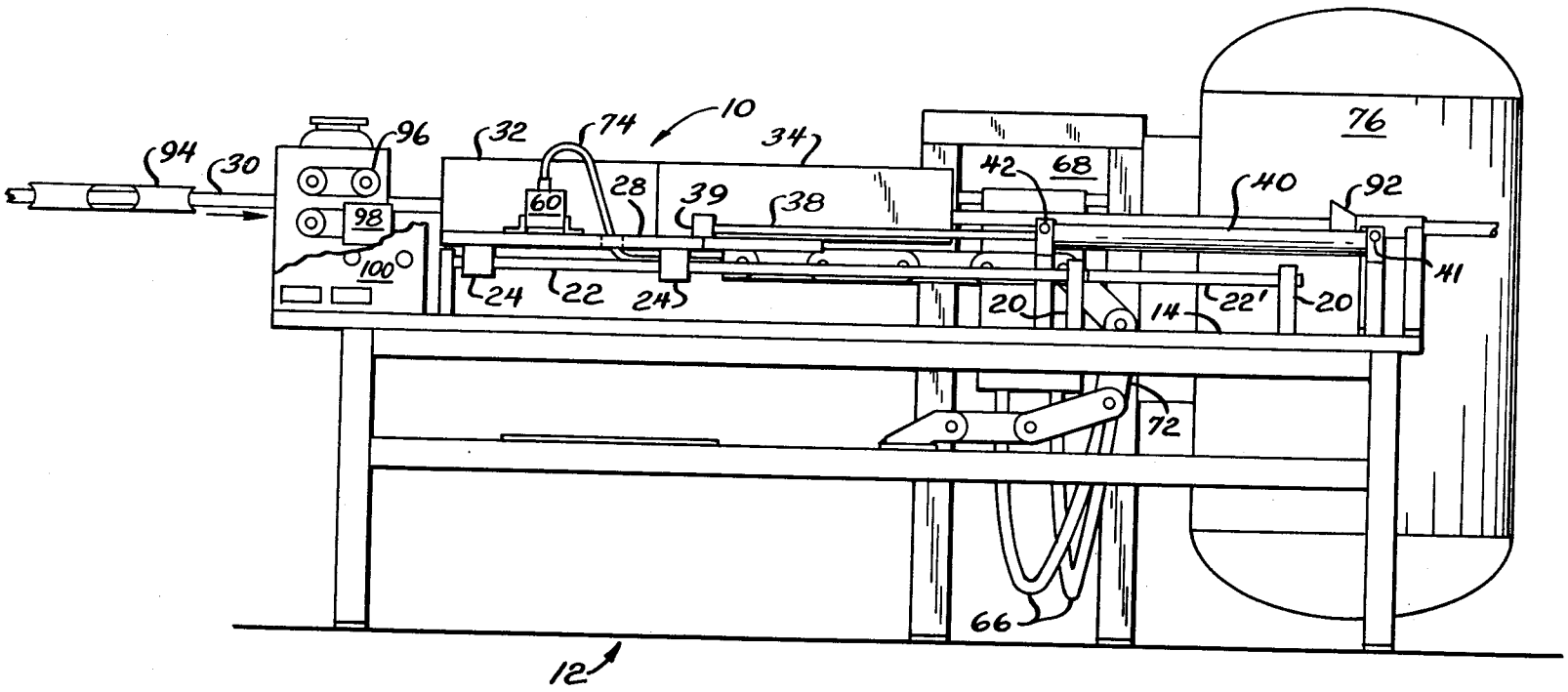
FIG. 2 is a side view of the apparatus of FIG. 1.

Referring to FIG. 1, the annealing apparatus 10 includes a base structure indicated generally at 12. The base includes an upper fixed support plate 14 and a lower fixed support plate 16. A first pair of support blocks 20 support a first guide rail member 22, while a second pair of support blocks 20 supports a second guide rail 22'. The support blocks 20 attach to the upper support plate 14 by any suitable means such as fasteners. Slidably mounted on the guide ways or rails 22, 22' are a plurality of spaced guide blocks 24 which are mounted to the underside of a reciprocable support plate or carriage member 28. Mounted at the upstream end of the apparatus relative to a length of tubing 30 being driven in the direction of the arrow is an annealing chamber 32 which is enclosed with a top plate 33. Immediately downstream of the annealing chamber 32 is a quenching chamber 34 which is also normally enclosed by a cover member 35.

The carriage assembly 28 including the annealing and quenching chambers 32, 34 is adapted to be reciprocated in an axial direction within the constraints provided by guide blocks 24 and guide rails 22, 22'. Movement in a downstream direction from the position shown in FIG. 1 is provided by clamping the carriage to the moving tubing 30 as will hereinafter be described.

Movement in an upstream direction is provided by the piston shaft 38 which is anchored to the carriage by a support block 39 at its upstream or extended end and by a piston (not shown) movable within the air cylinder 40 at its downstream end. The return movement of the piston rod 38 and carriage 28 are achieved by admitting air into the cylinder 40 through hose 41 and permitting it to exit through hose 42. In the downstream direction, each of the hoses 41, 42 is preferably valved to be in an exhaust mode so as to not resist the downstream movement of the carriage. Since the carriage may be returned to its upstream end very rapidly by the air cylinder 40, a hydraulic spring member 44 is preferably provided as a cushion.

The aformentioned positively driven tubing 30 provides the force for advancing the carriage 28 in a downstream direction. This is accomplished by a pair of fixed clamp members 52, 52' and a pair of movable clamp members 54, 54' which are attached to a movable clamp plate 56 so as to clamp the tubing 30 against the fixed clamp members 52, 52' when the piston shaft 58 of an air cylinder 60 is actuated. The fixed clamp members 52, 52' have conductive jaws which are each at a different electrical potential so as to cause resistance heating of the segment of tubing 30 clamped between them. The clamp members 52, 52' are mounted on brackets which electrically isolate them from the housing portion of the chamber 32. An insulating plate 62 electrically isolates the movable clamp members 54, 54' from each other and from the movable plate 56 to which they are attached. Electrical current is carried to the clamp members 52, 52' by water-cooled electrical cables 66 which are connected at their opposite ends to a transformer assembly 68. The cables 66 are quite thick and not extremely flexible, and are preferably supported for movement along with the carriage 28 by a power track assembly 72 which is rigidly attached to the carriage plate 28 at its upstream upper end and to the lower support plate 16 at its lower end. The links of the power track 72 are pivoted to each other, thus causing the movement of the cable 66 to be very well constrained. The power track assembly 72 has capacity to support a number of cable-like members, including the hoses 74, 75 which supply air to the clamp cylinder 60.

An inert atmosphere is preferably provided to each of the chambers 32, 34 from a source such as a nitrogen tank 76. Through appropriate valving (not shown) the gas is directed to the annealing chamber inlet tube 80 and the quench chamber inlet tube 82. The inert gas exits the two chambers through the openings at their ends 32', 34' through which the tubing 30 passes. The quench chamber 34 includes a water inlet nozzle 86 which preferably is fashioned so as to direct water to all portions of the periphery of the tube. This quench water is removed from the chamber through an outlet drain opening 88.

The tubing 30 is guided for movement away from the annealing apparatus 10 by a funnel-shaped exit guide 92. The downstream handling of the tubing forms no part of the present invention and could comprise appropriate structure for finning the spot annealed tubing on a continuous basis or simply structure to cut the tubing into short lengths or to recoil it. The tubing 30 is positively driven when it enters the annealing chamber 32 through opening 32'. It is preferably supplied in a large coil (not shown) and is passed through a series of straightening rollers 94, at least some of which are powered. The straightened tubing is passed through a wheel encoder device 96 whose wheels are rotated by the moving tube to generate counter pulses representative of tube displacement in a counter 98. A control panel 100 may contain appropriate controls to manually operate the apparatus 10. Preferably, however, the counter pulses generated by the counter 98, which are representative of tube displacement, are fed to a computer apparatus (not shown) which is programmed to operate the clamp cylinder 60, the return cylinder 40 and the application of power to the clamps. To prevent arcing, power is not directed to fixed clamp members 52, 52' until after cylinder 60 has been actuated to force the movable clamp portions 54, 54' against the tube. Similarly, the power to the fixed clamps is cut before the clamp cylinder 60 is released.

The annealing apparatus of the invention can be designed such that the power inputs, the travel times of the carriage and tubing while power is being applied, and the annealing temperature can be varied for various annealing requirements. The power can be varied by selecting a suitable transformer 68 which has adjustable taps. A suitable annealing temperature for copper tubing is 1200° F. which produces an annealed area between the clamps having a 15 grain size and a Rockwell 15T hardness of 57–60. Obviously, for a particular tube velocity, the power applied must be sufficient to produce the desired tube temperature and will vary depending upon the tube density, the distance between the clamps 52, 52', and the time duration of heat application. Since the time duration is limited by the tube velocity and the maximum travel capability of the carriage member 28, it is relatively simple to experiment when setting up the apparatus for a particular tube, until a power tap is found which can achieve the required temperature in the carriage travel available and then to provide variations in the time of power application until an exact temperature is achieved. The quench water admitted through nozzle 86 preferably flows continuously with a variable flow rate. Similarly, the nitrogen purge through pipes 80, 82 is also continuous with a variable flow rate.

We claim as our invention:

1. A method for selectively annealing spaced portions of a length of continuously moving tubing which is guided for movement in one direction of its axis comprising the steps of mounting an annealing chamber having tube receiving apparatus in its ends on a carriage for reciprocable movement relative to its mounting base in the direction of the tube axis so that one of said spaced portions of the length of tubing is within the chamber; fixedly clamping said spaced portion of the tubing relative to the annealing chamber at the upstream end thereof so that said carriage and annealing chamber will move with said continuously moving tubing in a downstream direction; heating said portion of the tubing to an annealing temperature while it is clamped; unclamping said tubing; and returning said carriage and annealing chamber to its original upstream position relative to its mounting base while said tubing continues to move in said one direction of its axis.

2. A method in accordance with claim 1 and including the additional step of cooling the heated portion of the tubing after it is unclamped by passing it through a liquid spray quenching chamber located immediately downstream from said annealing chamber.

3. A method in accordance with claim 2 wherein said cooling step is performed while said carriage and annealing chamber are being returned to their original upstream position.

4. A method in accordance with claim 2 wherein an inert atmosphere is provided to said annealing and quenching chambers.

* * * * *